US006602048B2

(12) United States Patent
Fujikawa et al.

(10) Patent No.: US 6,602,048 B2
(45) Date of Patent: Aug. 5, 2003

(54) GAS TURBINE SPLIT RING

(75) Inventors: Tatsuaki Fujikawa, Hyogo (JP); Yasuoki Tomita, Hyogo (JP); Shunsuke Torii, Hyogo (JP); Ryotaro Magoshi, Hyogo (JP); Masamitsu Kuwabara, Hyogo (JP); Shinichi Inoue, Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/998,201

(22) Filed: Dec. 3, 2001

(65) Prior Publication Data

US 2002/0098079 A1 Jul. 25, 2002

(30) Foreign Application Priority Data

Jan. 19, 2001 (JP) ..... 2001-011593

(51) Int. Cl.[7] ..... F01D 11/24

(52) U.S. Cl. ..... 415/116; 415/138; 415/173.1; 415/173.2; 415/175; 415/176; 415/178

(58) Field of Search ..... 415/138, 139, 415/173.1, 173.2, 173.3, 175–178, 115, 116

(56) References Cited

U.S. PATENT DOCUMENTS

| | | | | |
|---|---|---|---|---|
| 3,860,358 A | * | 1/1975 | Cavicchi et al. | 415/173.1 |
| 4,784,569 A | * | 11/1988 | Sidenstick et al. | 415/173.1 |
| 6,019,572 A | * | 2/2000 | Cunha | 415/115 |
| 6,146,091 A | * | 11/2000 | Watanabe et al. | 415/115 |
| 6,302,642 B1 | * | 10/2001 | Nagler et al. | 415/116 |
| 6,409,471 B1 | * | 6/2002 | Stow | 415/173.1 |

FOREIGN PATENT DOCUMENTS

JP 2000-062492 3/2000

* cited by examiner

*Primary Examiner*—Christopher Verdier
(74) *Attorney, Agent, or Firm*—Oblon, Spivak, McClelland, Maier & Neustadt, P.C.

(57) ABSTRACT

In the gas turbine split ring, on an outer peripheral surface 1*b* between two cabin attachment flanges, a circumferential rib which extends in the circumferential direction and an axial rib which extends in the axial direction and has a height taller than that of the circumferential rib are, respectively, formed in plural lines, so that it is possible to suppress heat deformation in the axial direction which largely contributes to reduction of the tip clearance compared to head deformation in the circumferential direction more efficiently.

3 Claims, 12 Drawing Sheets

FIG. 3 RELATED ART
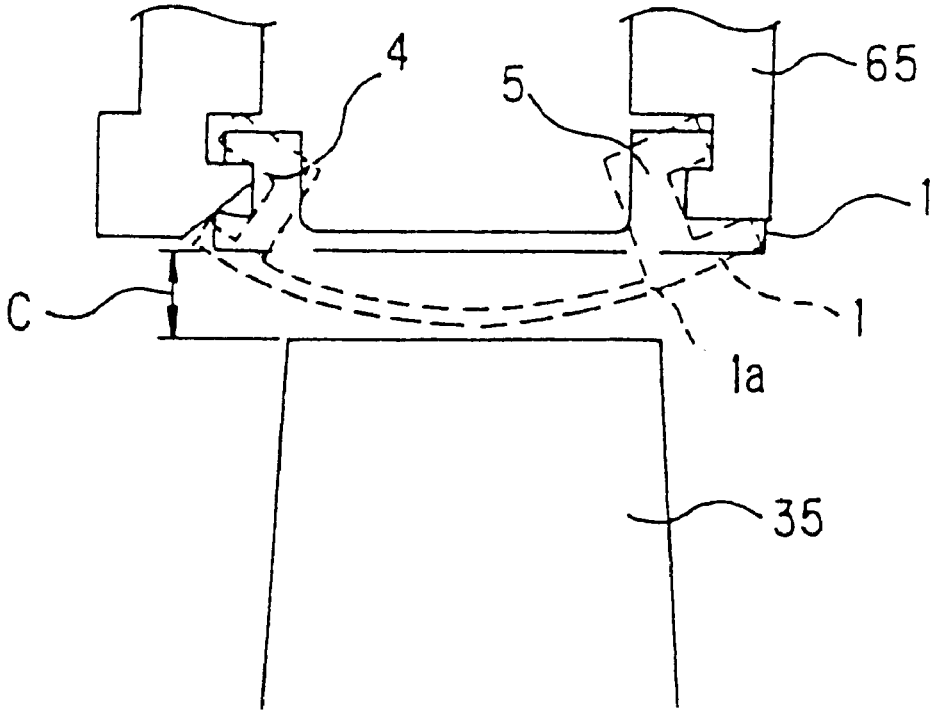

FIG. 12 RELATED ART
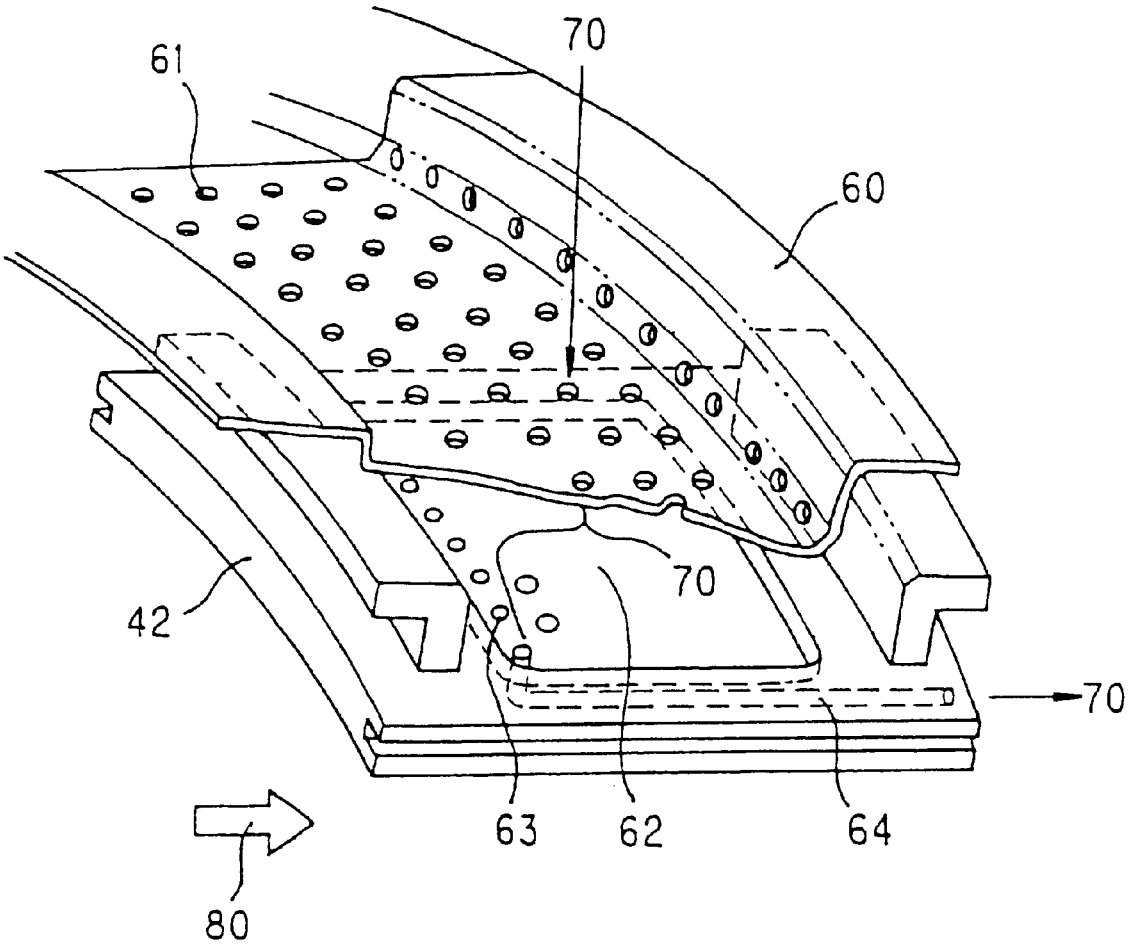

GAS TURBINE SPLIT RING

FIELD OF THE INVENTION

The present invention relates to a gas turbine split ring and. More specifically, this invention relates to a split ring which appropriately secures an interval (chip clearance) with respect to a tip end of a moving blade in the operating state of a gas turbine (under high temperatures).

BACKGROUND OF THE INVENTION

FIG. 10 shows a general section view showing a front stage part in a gas passage part of a gas turbine. In the drawing, to an attachment flange 31 of a combustor 30, an outer shroud 33 and an inner shroud 34 which fix each end of a first stage stationary blade (1*c*) 32 are attached, and the first stage stationary blade 32 is circumferentially arranged in plural about the axis of the turbine and fixed to the cabin on the stationary side.

On the downstream side of the first stage stationary blade 32, a first stage moving blade (1*s*) 35 is arranged in plural, and the first stage moving blade 35 is fixed to a platform 36, the platform 36 being fixed to the periphery of a rotor disc so that the first stage moving blade 35 rotates together with the rotor. Furthermore, in the periphery to which the tip end of the first stage moving blade 35 neighbors, a split ring 42 of circular ring shape having a plural split number is attached and fixed to the side cabin side.

On the downstream side of the first stage moving blade 35, a second stage stationary blade (2*c*) 37 of which each side is fixed to an outer shroud 38 and an inner shroud 39 is circumferentially attached in plural to the stationary side in the same manner as the first stage stationary blade 32. Furthermore, on the downstream side of the second stationary stage 37, a second stage moving blade (2*s*) 40 is attached to the rotor disc via a platform 41, and in the periphery to which the tip end of the second stage moving blade 40 neighbors, a split ring 43 of circular ring shape having a plural split number is attached.

The gas turbine having such a blade arrangement is configured by, for example, four stages, wherein high temperature gas 50 obtained by combustion in the combustor 30 enters from the first stage stationary blade 32, expands while flowing between each blade of the second to fourth stages, supplies rotation power to the rotor by rotating each of the moving blades 35, 40 or the like, and then is discharged outside.

FIG. 11 is a detailed section view of the split ring 42 to which the tip end of the first stage moving blade 35 neighbors. In this drawing, a number of cooling ports 61 are provided in an impingement plate 60 so as to penetrate through it, and this impingement plate 60 is attached to a heat shielding ring 65.

Also the split ring 42 is attached to the heat shielding ring 65 by means of cabin attachment flanges formed on both the upstream and downstream sides of main flow gas 80 which is the high temperature gas 50. Inside the split ring 42, a plurality of cooling passages 64 thorough which the cooling air passes are pierced in the flow direction of the main flow gas 80, and one opening 63 of the cooling passage 64 opens to the outer peripheral surface on the upstream side of the split ring 42, while another opening opens to the end surface on the downstream side.

In the above-mentioned configuration, cooling air 70 extracted from a compressor or supplied from an external cooling air supply source flows into a cavity 62 via the cooling port 61 of the impingement plate 60, and the cooling air 70 having flown into the cavity 62 comes into collision with the split ring 42 to forcefully cool the split ring 42, and then the cooling air 70 flows into the cooling passage 64 via the opening 63 of the cavity 62 to further cool the split ring 42 from inside, and is finally discharged into the main flow gas 80 via the opening of the downstream side.

FIG. 12 is a perspective view of the above-described split ring 42. As shown in the drawing, the split ring 42 is composed of a plurality of split structure segments divided in the circumferential direction about the axis of the turbine, and a plurality of these split structure segments are connected in the circumferential direction to form the split ring 42 having a circular ring shape as a whole. On the outside (upper side in the drawing) of the split ring 42 is provided the impingement plate 60 which forms the cavity 62 together with the recess portion of the split ring 42.

The impingement plate 60 is formed with a number of cooling ports 61, and the cooling air 70 flows into the cavity 62 via the cooling ports 61, comes into collision with the outer peripheral surface of the split ring 42, cools the split ring 42 from outer peripheral surface, flows into the cooling passage 64 via the opening 63, flows through the cooling passage 64, and is discharged into the main flow gas 80 from the end surface, whereby the cooling air 70 cools the split ring from inside in the course of passing through the cooling passage 64.

As described above, the split ring of the gas turbine is cooled by the cooling air, however, in the operating state of the gas turbine, since the surface of the split ring is exposed to the main flow gas 80 of extremely high temperature, the split ring will heat expand in both the circumferential and the axial direction.

The interval between the tip end of the moving blade of the gas turbine and the inner peripheral surface of the split ring becomes small under high temperatures or under the operating state due to the influence of centrifugal force and heat expansion in comparison with the situation under low temperatures or under the unoperating state, and it is usual to determine a design value and a management value of the tip clearance in consideration of the amount of change of this interval. In practice, however, the inner peripheral surface of the split ring often deforms into a shape which is not a shape that forms apart of the cylindrical surface because of a temperature difference between the inner peripheral side and the outer peripheral side of the split ring, so that there is a possibility that the rotating moving blade and the split ring at rest interfere with each other to cause damages of both members.

In view of the above situation, the applicant of the present invention has proposed a split ring in which for the purpose of suppressing the heat deformation under high temperatures, on the outer peripheral surface between two cabin attachment flanges in the split structure segments constituting the split ring, a circumferential rib extending in the circumferential direction and an axial rib extending in the direction parallel to the axis of the circular ring shape are formed in plural lines to provide a rib in the shape of a waffle grid as a whole (Japanese Patent Application No. 2000-62492). According to this invention, the rib in the form of a waffle grid suppresses the heat deformation, making it possible to secure an appropriate tip clearance.

However, even by the above proposition of the present applicant, that is, by formation of the rib in the form of a waffle grid, it is impossible to suppress the heat deformation of the split ring satisfactorily.

SUMMARY OF THE INVENTION

It is an object of the invention to provide a split ring which makes it possible to secure a tip clearance with respect to a tip end of a moving blade in the operating state of a gas turbine (under high temperatures).

The gas turbine split ring according to one aspect of the present invention is a gas turbine split ring which is provided on a peripheral surface in a cabin at a predetermined distance with respect to a tip end of a moving blade, the split ring being made up of a plurality of split structure segments that are connected in the circumferential direction to form the split ring of a circular ring shape, each split structure segment having cabin attachment flanges extending in the circumferential direction on both of the upstream and downstream sides of high temperature gas. On an outer peripheral surface between two cabin attachment flanges of the split structure segment, a circumferential rib which extends in the circumferential direction and an axial rib which extends in the direction parallel to the axis of the circular ring shape and has a height taller than the circumferential rib are formed in plural lines. That is, in this gas turbine split ring, the axial rib is formed to be higher than the circumferential rib in the waffle grid rib formed on the outer peripheral surface of the gas turbine split ring.

The height of the axial rib is designed to be larger than that of the circumferential rib as described above on the basis of the findings by means of simulation made by the inventors of the present application that heat deformation in the axial direction contributes to reduction of the tip clearance more largely than heat deformation in the circumferential direction. Also from the view point of not preventing the cooling air supplied via the cooling ports of the impingement plate from flowing into the openings of the cooling passages formed on the outer peripheral surface of the split ring, the height of the circumferential rib is suppressed.

That is, the split ring is formed by connecting a plurality of split structure segments in the circumferential direction as described above, and since a clearance is formed at the connecting portion in expectation of heat expansion under high temperatures, heat deformation can be absorbed more or less at this clearance part, while on the other hand, as for the axial direction, since two cabin attachment flanges are attached to the cabin without leaving a clearance, heat deformation cannot be absorbed, and the peripheral wall part between two cabin attachment flanges protrudes to the moving blade side to reduce the tip clearance.

In view of the above, according to the gas turbine split ring of the present invention, by forming the axial rib to be higher than the circumferential rib in the waffle grid rib formed on the outer peripheral surface of the split ring, the section modulus in the axial direction is made smaller than that of the conventional case, and the amount of heat deformation in the axial direction which contributes to the change of the tip clearance more largely than heat deformation in the circumferential direction, with the result that it is possible to suppress the change of the tip clearance due to a temperature difference compared to the conventional case.

The gas turbine split ring according to an another aspect of the present invention is a gas turbine split ring which is provided on a peripheral surface in a cabin at a predetermined distance with respect to a tip end of a moving blade, the split ring being made up of a plurality of split structure segments that are connected in the circumferential direction to form the split ring of a circular ring shape, each split structure segment having cabin attachment flanges extending in the circumferential direction on both of the upstream and downstream sides of high temperature gas. The split ring is formed to have a shape before heat deformation such that the inner peripheral surface of the split structure segment and the tip end of the moving blade has a predetermined interval in heat deformed condition in the operating state of the gas turbine.

In the above-mentioned gas turbine split ring, the split ring is formed into a shape in expectation of heat deformation so that the tip clearance becomes a predetermined clearance in the condition after heat deformation regardless of presence/absence of the waffle grid rib.

According to the gas turbine split ring, the shape of the split ring before heat deformation is formed in expectation of heat deformation regardless of presence/absence of the waffle grid rib, with the result that it is possible to control the tip clearance after heat deformation more properly.

Other objects and features of this invention will become apparent from the following description with reference to the accompanying drawings.

BRIEF DESCRIPTION OF THE DRAWINGS

FIG. 3 is a view showing heat deformation of the split ring;

FIG. 12 is a perspective view of the conventional split ring.

DETAILED DESCRIPTION

Embodiments of the gas turbine split ring according to the present invention will be concretely explained with reference to the accompanying drawings.

Figure 1A:
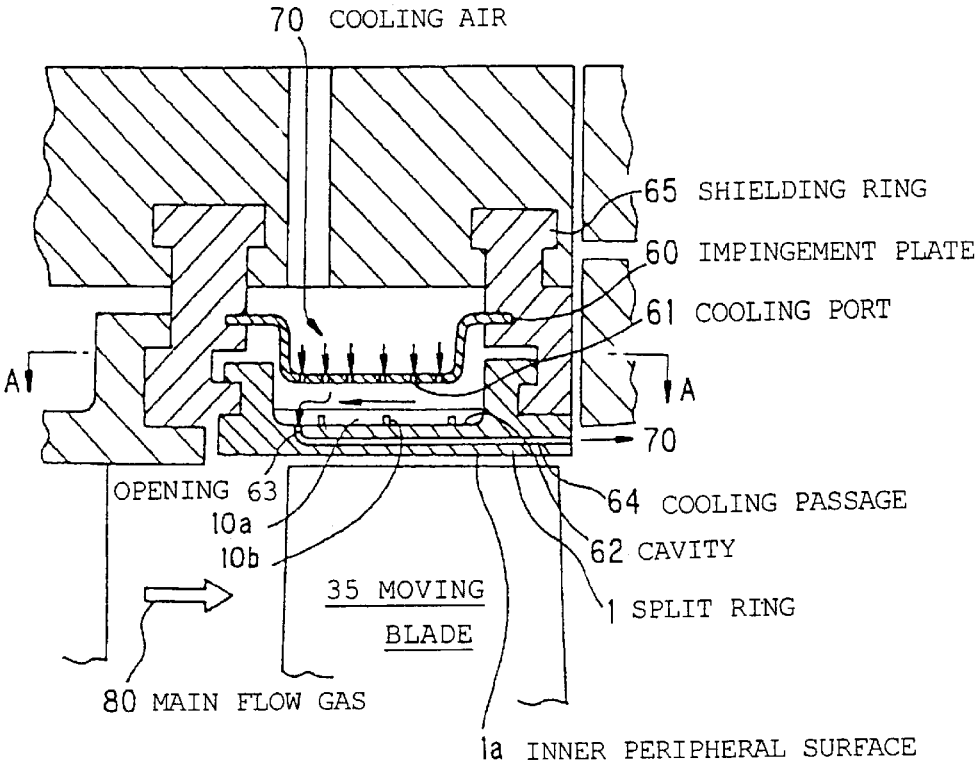
FIG. 1A is a sectional view of a split ring according to a first embodiment of the present invention.
Figure 1B:
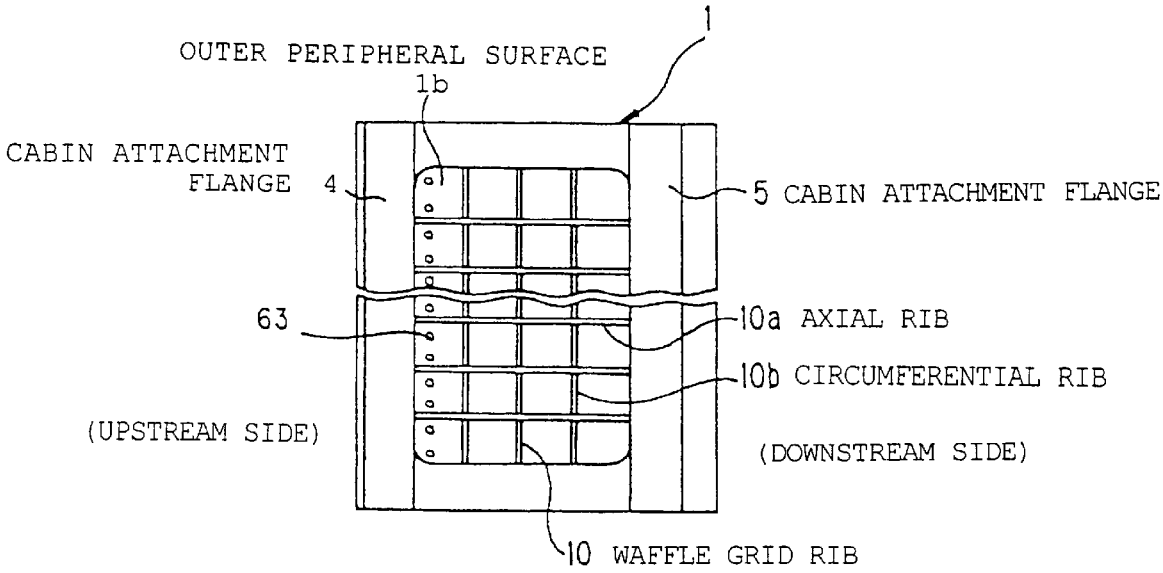
FIG. 1B is a view taken in the direction of the arrows A—A in FIG. 1A.

FIG. 1A is a sectional view of a split ring according to a first embodiment, and FIG. 1B is a view taken in the direction of the arrows A—A in FIG. 1A. In FIG. 1, the split ring 1 shows one of a plurality of split structure segments constituting a split ring of circular ring shape, the split ring 1 being attached to the heat shielding ring 65, having the opening 63 in the cavity 62, and being provided with a number of cooling passages 64 opening to the end surface on the downstream of the main flow gas 80 in the same manner as the conventional split structure segment. Also the impingement plate 60 is attached to the heat shielding ring 65 in the same manner as the conventional case. On both ends on the upstream and downstream sides of the split ring 1, the cabin attachment flanges 4, 5 extending in the circumferential direction are provided.

On an outer peripheral surface 1*b* of the split ring 1 is formed a waffle grid rib 10 consisting of a circumferential rib 10*b* extending in the circumferential direction and an axial rib 10*a* extending in the axial direction. The height of the circumferential rib 10*b* is 3 mm, while the axial rib 10*a* is formed to be 12 mm high and taller than the circumferential rib 10*b*.

Figure 2:
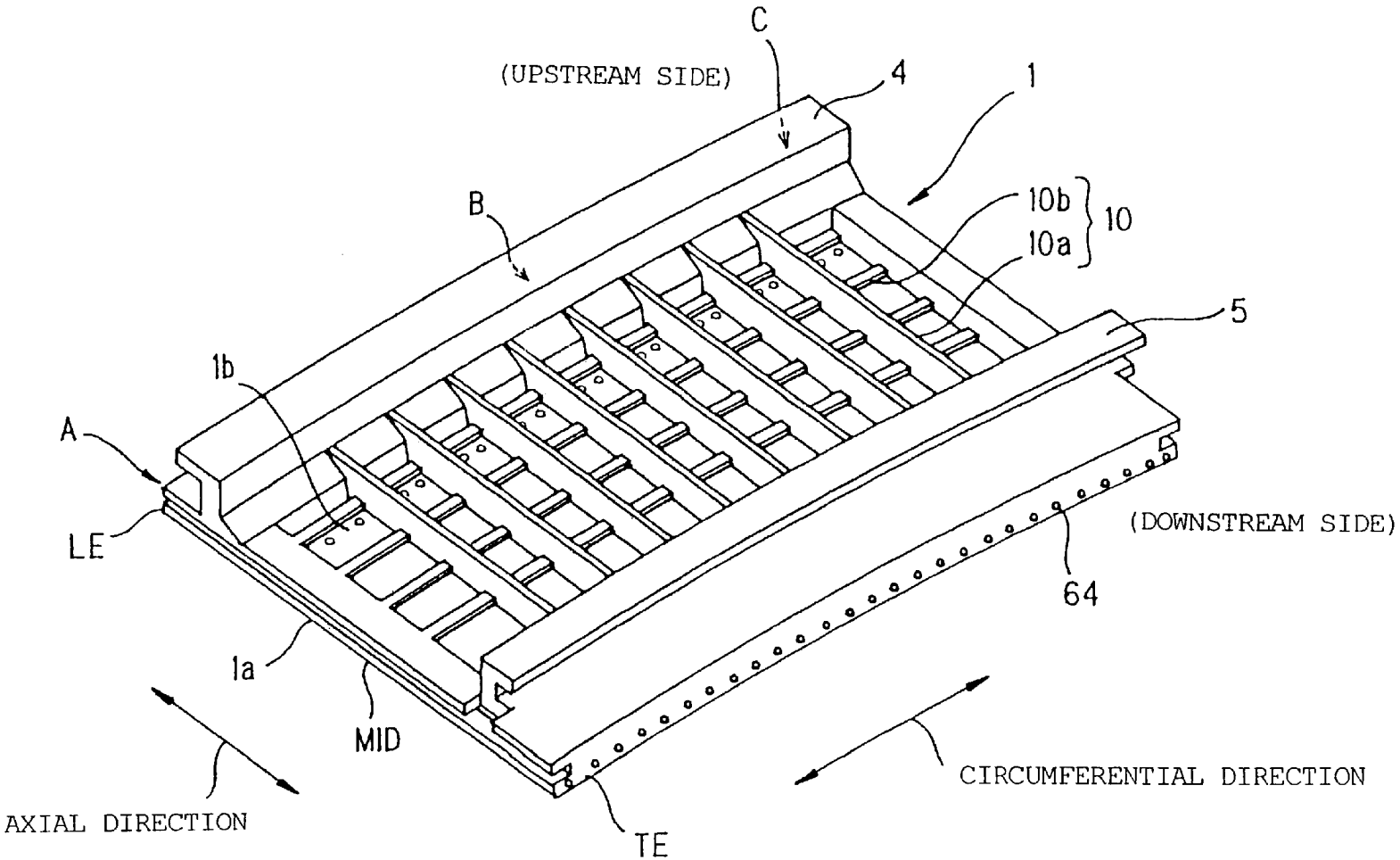
FIG. 2 is a perspective view of the split ring shown in FIG. 1A.

FIG. 2 is a perspective view of a single split ring 1, and by connecting a plural number of split rings 1 along the circumferential direction (shown in the drawing) so as to neighbor to the tip end of the moving blade while leaving an appropriate tip clearance C, the split ring 1 having a circular ring shape as a whole is formed. The number to be connected is determined in accordance with the size of the split ring and the length of arrangement circle for achieving arrangement of one circle of the circular ring (for example, about 40 segments).

In the split ring 1 having the configuration as described above, the cooling air 70 extracted from a compressor as shown in FIG. 1 or supplied from an external cooling air supply source flows into the cavity 62 via the number of cooling ports 61 formed in the impingement plate 60, comes into collision with the outer peripheral surface 1*b* of the split ring 1 to impinge-cool the split ring 1, and flows into the cooling passage 64 via the opening 63, flows through the cooling passage 64 while cooling the interior of the split ring 1, and is finally discharged into the main flow gas 80 via the opening of the downstream side.

As described above, though the split ring 1 is cooled by the cooling air 70, the conventional split ring 1 heat deforms because of a temperature difference between the inner peripheral surface 1*a* which is directly exposed to the main flow gas 80 which is high temperature burned gas and the outer peripheral surface 1*b* which does not contact with the main flow gas 80, and the tip clearance C with respect to the tip end of the moving blade 35 becomes small as indicated by the broken line in FIG. 3, so that the desired tip clearance C is no longer secured and there arises a possibility that the rotating moving blade 35 and the inner peripheral surface 1*a* at rest of the split ring 1 interfere with each other and both members get damaged.

However, according to the split ring 1 of the first embodiment, owing to the waffle grid rib 10 formed on the outer peripheral surface 1*b*, heat deformation in the circumferential direction and in the axial direction is suppressed, so that reduction of the above-mentioned tip clearance C is also suppressed. In addition, though the degree of contribution to reduction in the tip clearance C is larger in the axial deformation than in the circumferential deformation, in the split ring 1 which is the first embodiment of the invention, the axial rib 10*a* is formed to be higher than the circumferential rib 10*b* in the waffle rigid rib 10, with the result that it is possible to further suppress the heat deformation.

Figure 4A:
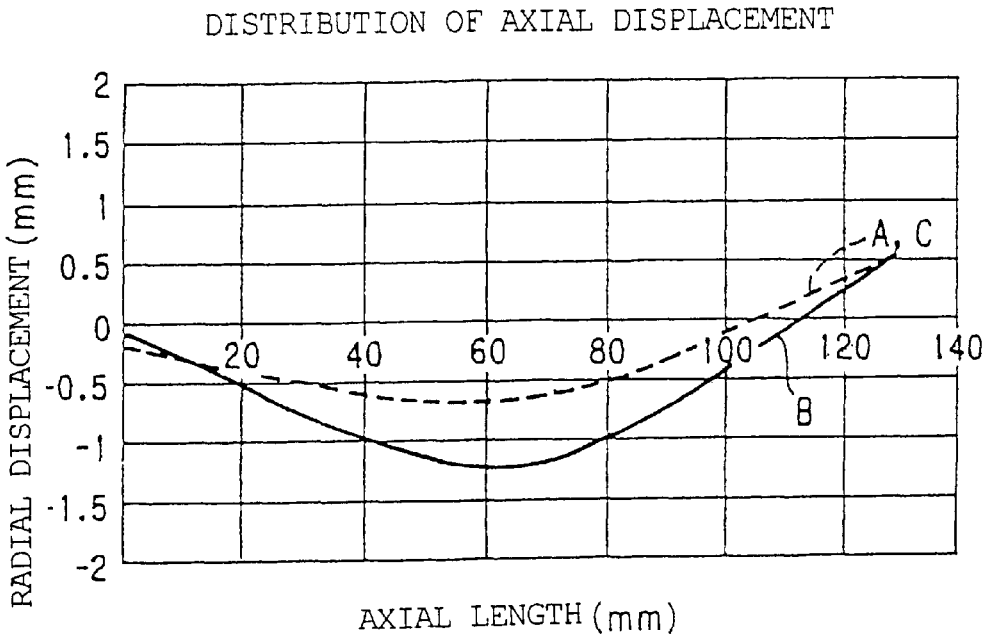
FIG. 4A and FIG. 4B are views showing simulation results of heat deformation in the axial direction and the circumferential direction of the split ring (part 1)
Figure 4B:
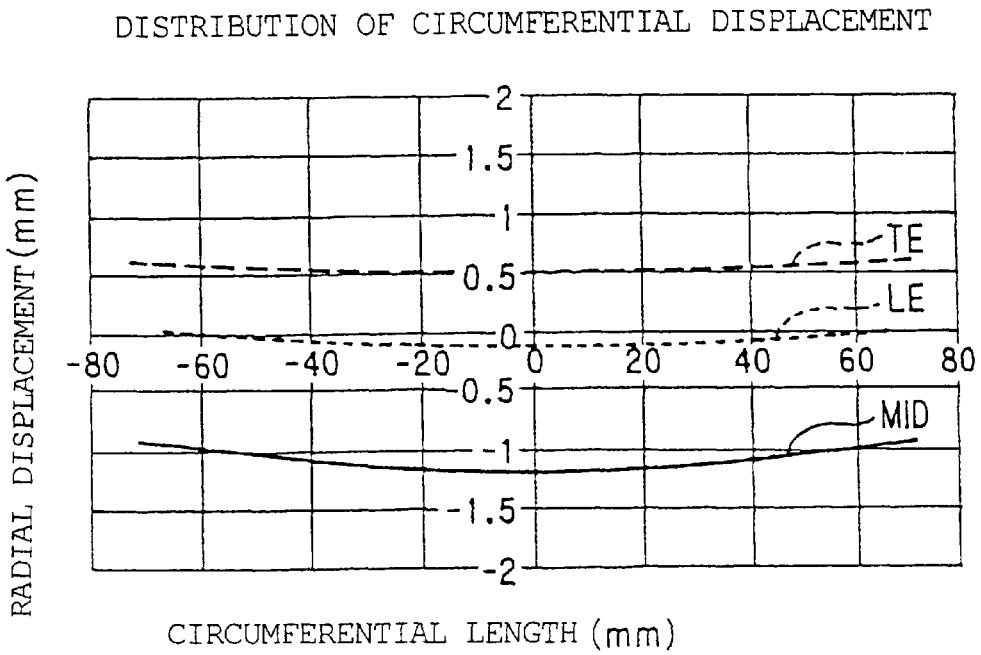
Figure 5A:
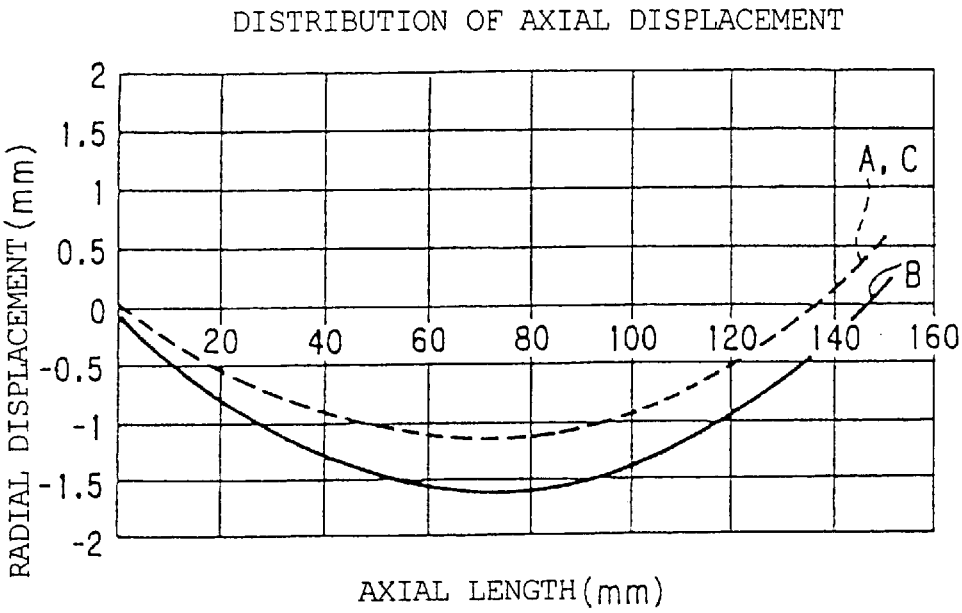
FIG. 5A and FIG. 5B are views showing simulation results of heat deformation in the axial direction and the circumferential direction of the split ring (part 2)
Figure 5B:
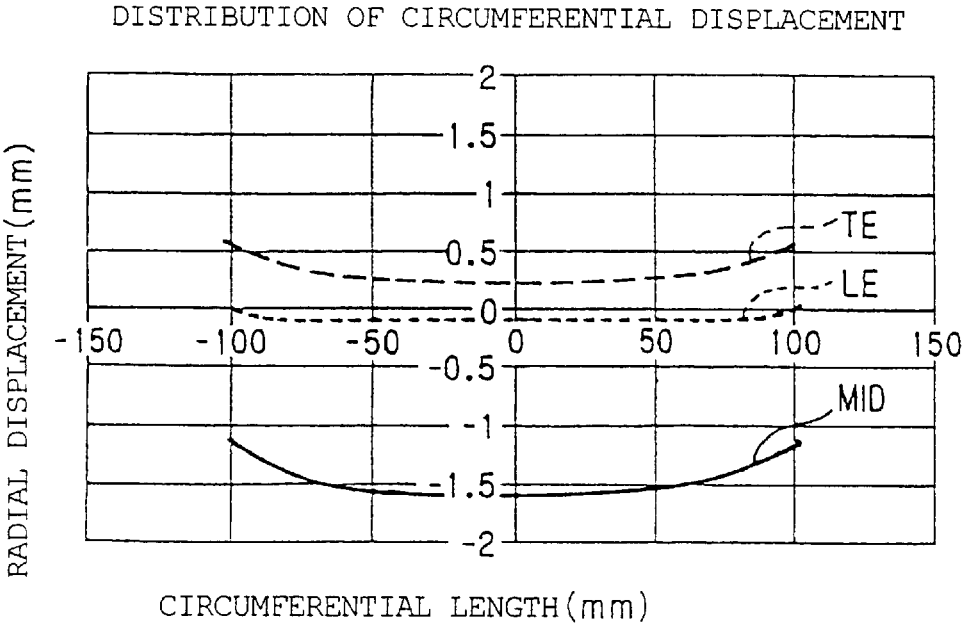
Figure 6A:
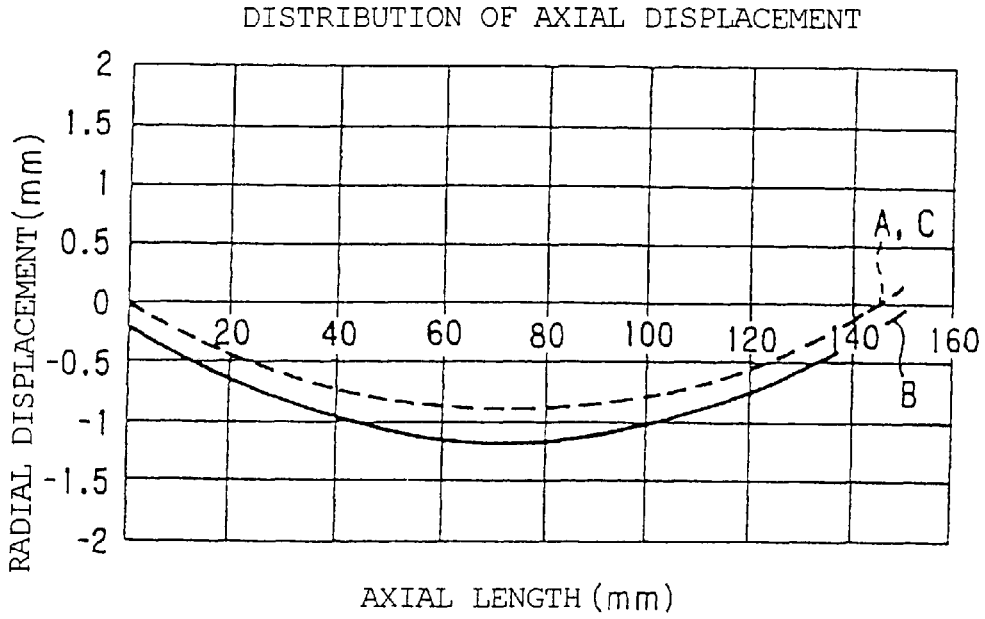
FIG. 6A and FIG. 6B are views showing simulation results of heat deformation in the axial direction and the circumferential direction of the split ring (part 3)
Figure 6B:
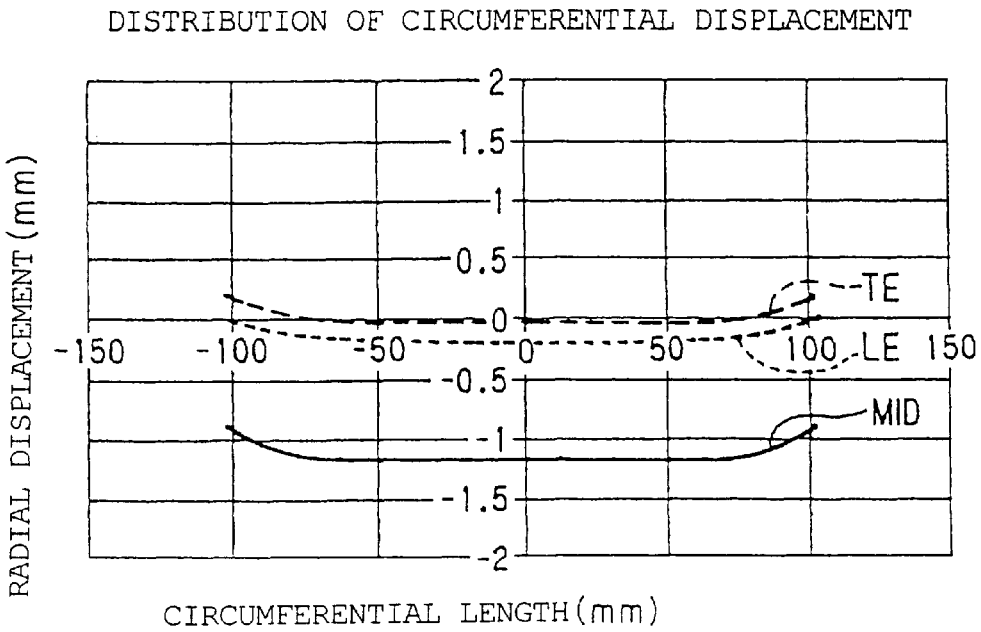
Figure 7A:
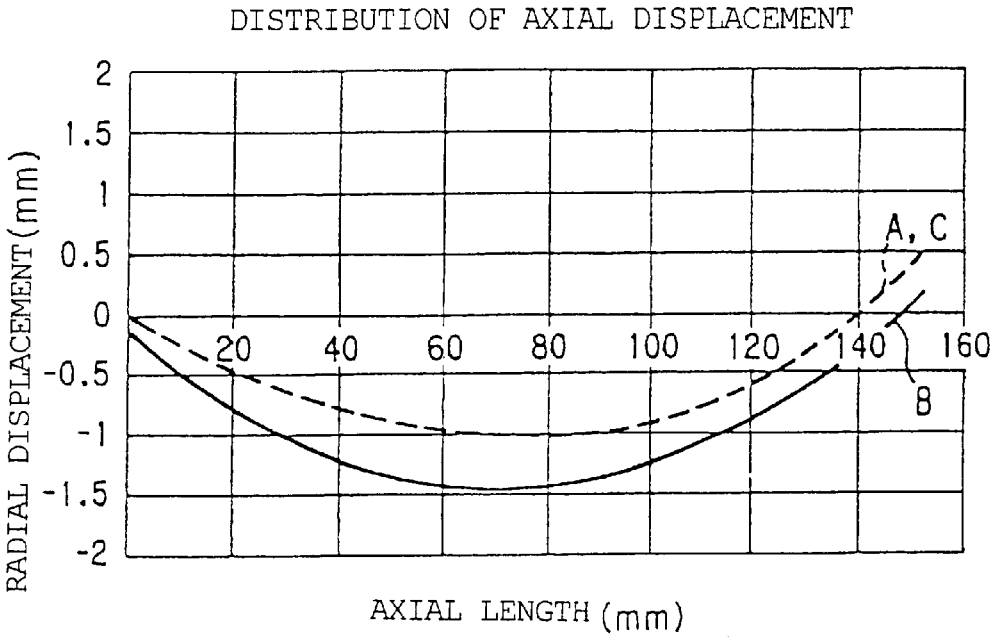
FIG. 7A and FIG. 7B are views showing simulation results of heat deformation in the axial direction and the circumferential direction of the split ring (part 4)
Figure 7B:
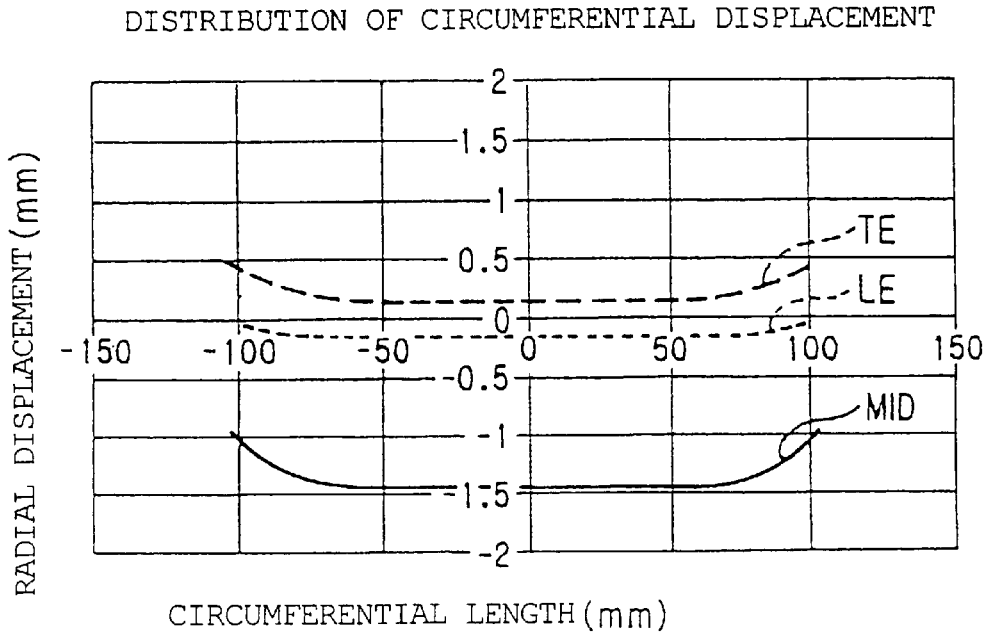

FIG. 4A to FIG. 7B show comparison results in which heat deformed conditions of the split ring under high temperatures are determined by simulation. Each of FIG. 4A, FIG. 5A, FIG. 6A, and FIG. 7A shows a radial displacement along the axial direction at each point A, B, C in the circumferential direction of FIG. 2, and each of FIG. 4B, FIG. 5B, FIG. 6B, and FIG. 7B shows a radial displacement along the circumferential direction at each point LE (Leading Edge), MID (middle) , TE (Trailing Edge) in the axial direction of FIG. 2. Moreover, FIG. 4A and FIG. 4B show the result for the conventional split ring not having a waffle grid rib, FIG. 5A and FIG. 5B show the result for the split ring having a waffle grid rib of which axial rib and the circumferential rib are 3 mm high (width of 2 mm and pitch of 20 mm for the axial rib), and FIG. 6A to FIG. 7B show the results for the split ring according to the first embodiment having a waffle grid rib of which circumferential rib is 3 mm high and axial rib is 12 mm high (width of 2 mm and pitch of 20 mm for the axial rib), and FIG. 4A to FIG. 6B show the results at the maximum metal temperature of 880° C. and FIG. 7A and FIG. 7B show the result at the maximum metal temperature of 1020° C.

As is evident from these drawings, under the same metal temperature, as for the split ring 1 according to the first embodiment shown in FIG. 6A and FIG. 6B, the amount of displacement is reduced both in the axial direction and in the circumferential direction in comparison with the split ring not having a waffle grid rib or the split ring having a waffle grid rib of which ribs in the axial direction and the circumferential direction are 3 mm high, and it was also proved that the distribution range of the amount of displacement along the circumferential direction at each of the points LE, MID, TE and the distribution range of the amount of displacement along the axial direction at each of the points A, B, C are reduced.

Also as for the split ring 1 according to the first embodiment under the maximum metal temperature of 1020° C. (FIG. 7A and FIG. 7B), it was confirmed that the amount of displacement is smaller than those of the conventional split ring (FIG. 4A and FIG. 4B) and the split ring having a waffle grid rib having the same height in the axial direction and the circumferential direction (FIG. 5A and FIG. 5B) under the maximum metal temperature of 888° C.

As described above, according to the gas turbine split ring 1 of the first embodiment, the amount of heat deformation in the axial direction which largely contributes to the change in the tip clearance C is predominantly made smaller than that of the conventional case, so that it is possible to efficiently suppress the change of tip clearance C due to the temperature difference.

Figure 8:
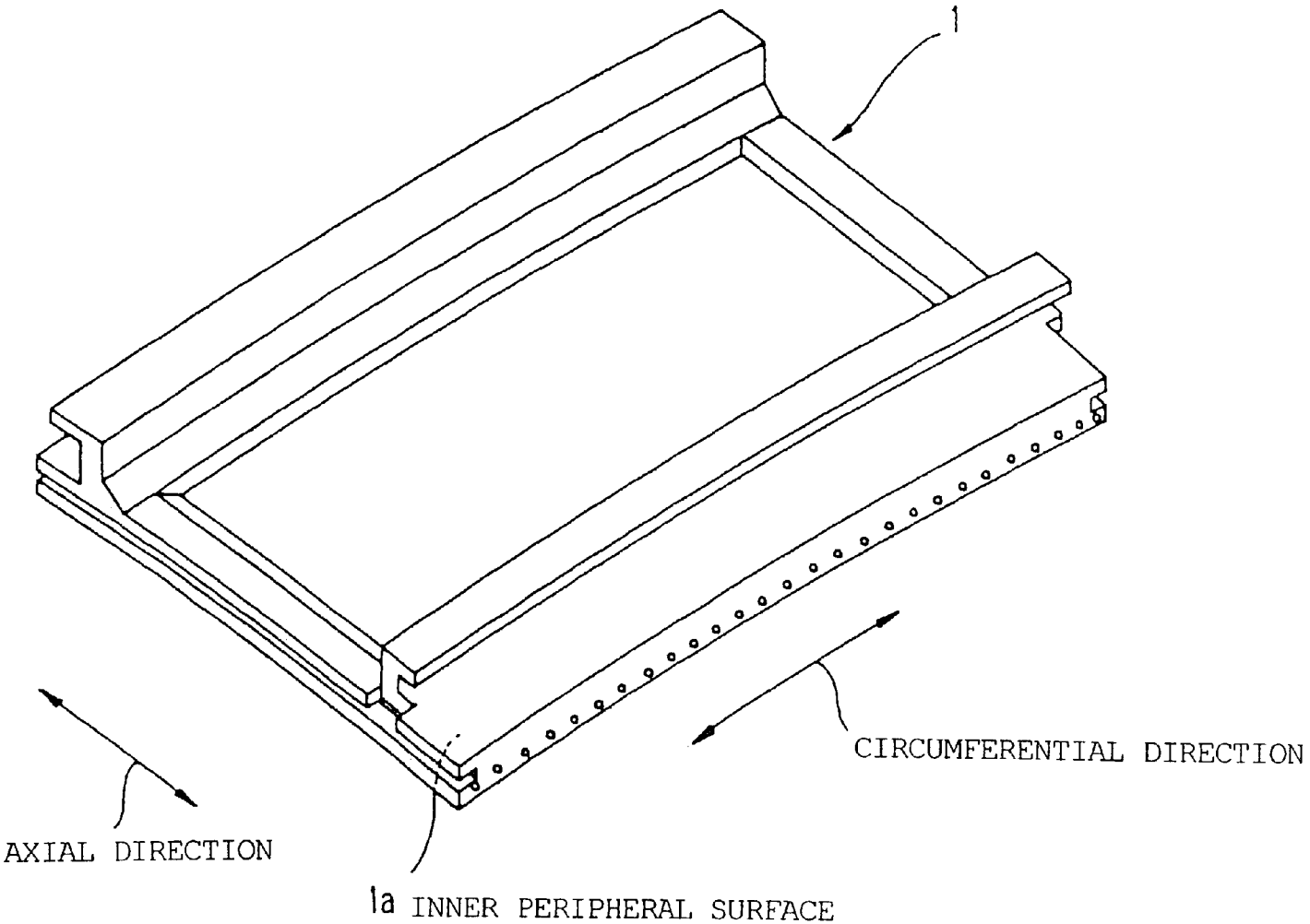
FIG. 8 is a perspective view showing a gas turbine split ring according to a second embodiment of the present invention.

FIG. 8 shows the split ring 1 according to a second embodiment. The split ring 1 is such that, in the conventional split ring not having a waffle grid rib, the inner peripheral surface 1*a* opposing to the tip end of the moving blade 35 is formed into a recess shape with respect to the moving blade 35 under normal temperatures (low temperatures at the time of unoperating state of the gas turbine).

Figure 9:
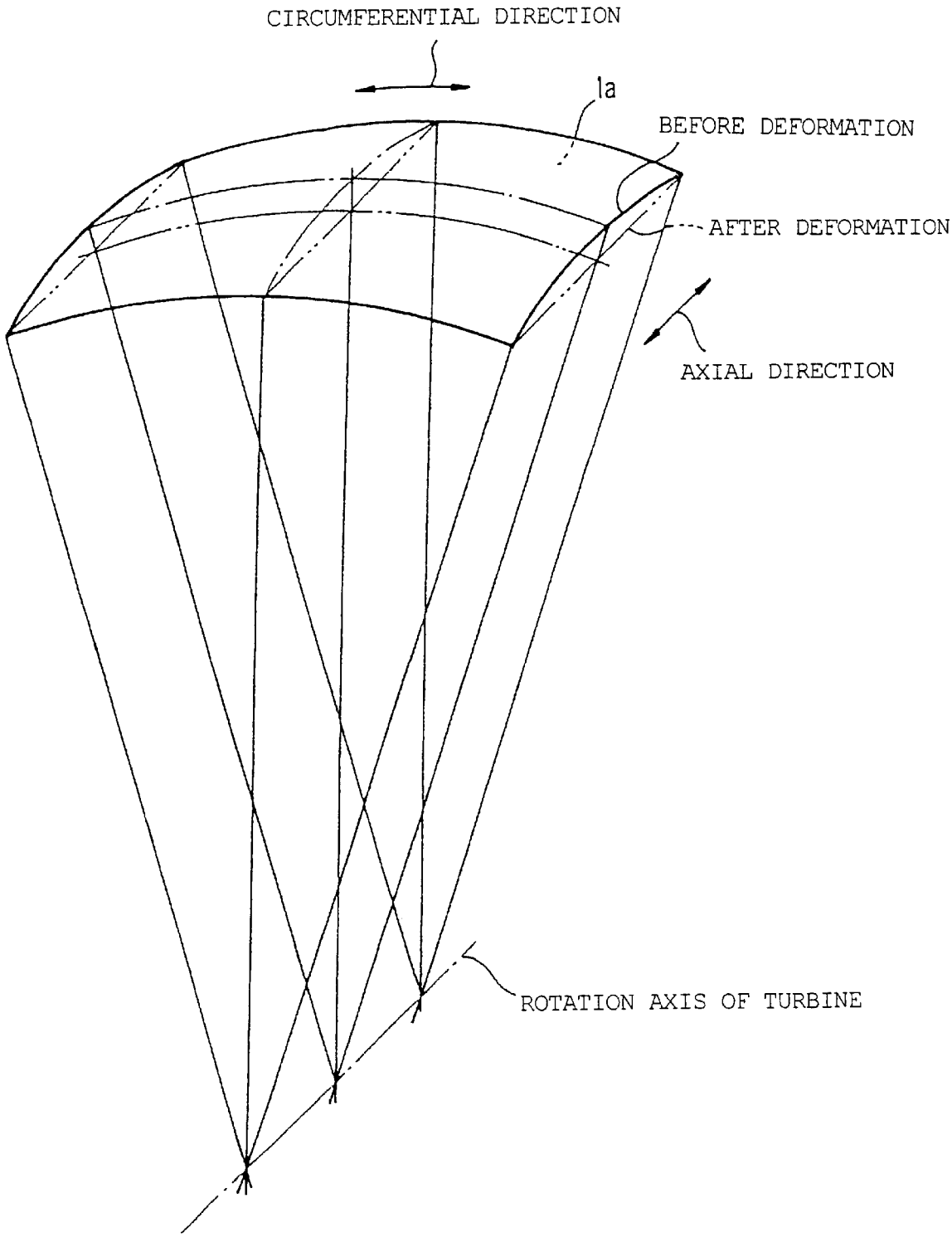
FIG. 9 is a view showing the shape of the inner peripheral surface of the split ring shown in FIG. 8.
Figure 10:
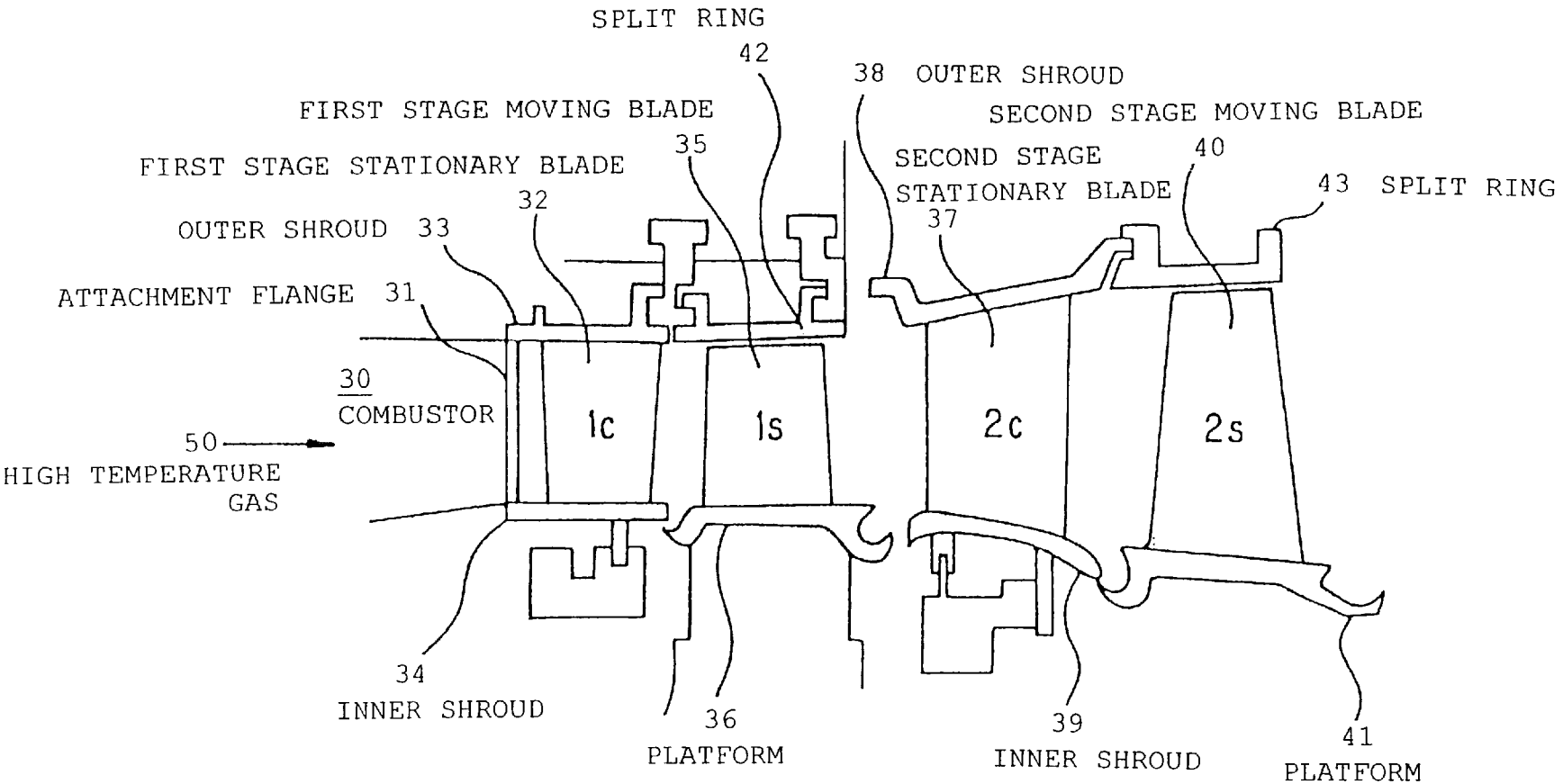
FIG. 10 RELATED ART
FIG. 10 is a general section view showing a gas passage part of a gas turbine.
Figure 11:
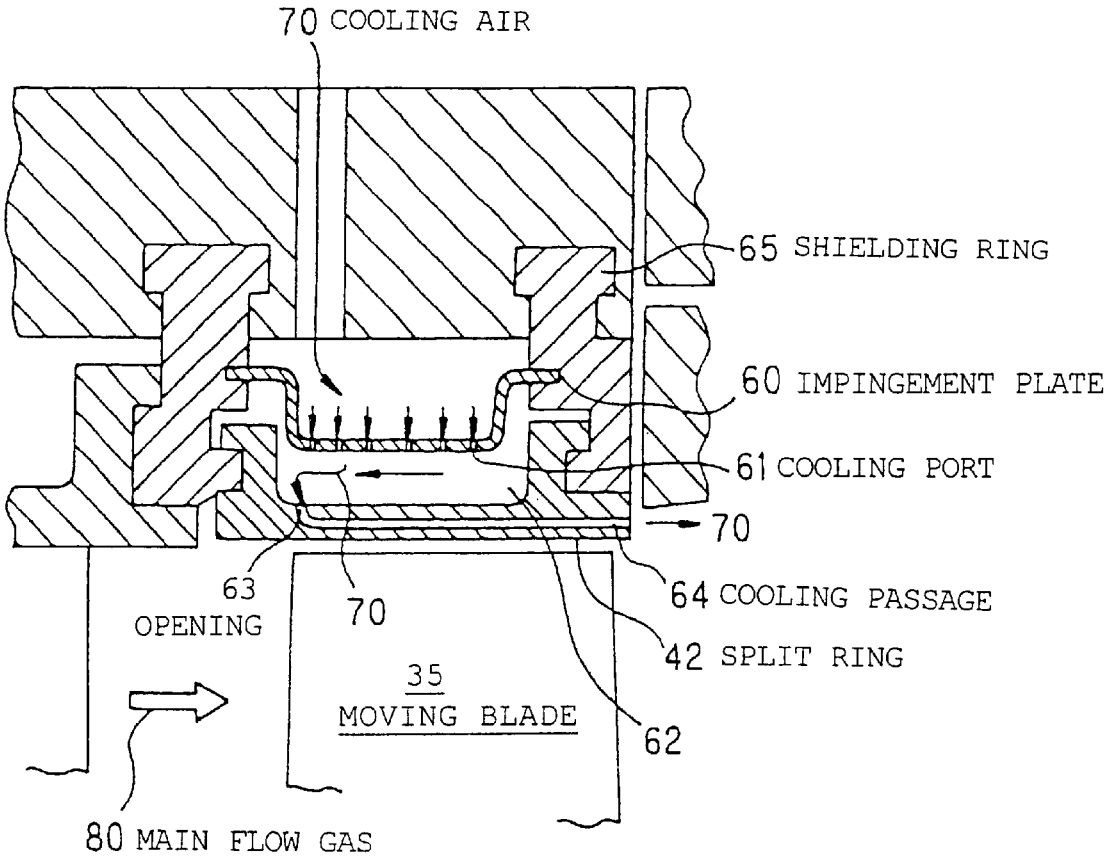
FIG. 11 RELATED ART
FIG. 11 is a section view of a conventional split ring to which a first stage moving blade neighbors.

As shown in FIG. 9 in detail, this recess shape is a shape under normal temperatures (denoted by the solid bold line in FIG. 9) that is designed in expectation of heat deformation so that the tip clearance C between the tip end of the moving blade 35 and the substantially center part in the axial direction of the inner peripheral surface 1*a* becomes a desired value after heat deformation (denoted by the double dotted line in FIG. 9) in the operating state of the gas turbine (under high temperatures), and is a shape such that the distance with respect to the moving blade 35 under normal temperatures decreases with distance from the substantially center part of the inner peripheral surface 1*a* to both of the upstream and downstream sides.

As explained with regard to FIG. 3, in the conventional split ring, heat deformation occurs so that it protrudes to the tip end side of the moving blade 35 under high temperatures because of operation of the gas turbine, and hence the tip clearance C at the substantially center part in the axial direction of the inner peripheral surface 1*a* becomes insufficient, however, according to the split ring 1 of the second embodiment, the tip clearance C becomes a desired optimum value after heat deformation and such shortage will not occur.

The split ring 1 of the second embodiment is formed into a recess shape in its entirety, however, since the essential feature is that at least the tip clearance C between the inner peripheral surface 1*a* and the tip end of the moving blade 35 becomes a desired value after heat deformation, only the inner peripheral surface 1*a* is formed into a recess shape instead of forming the entire split ring 1 into a shape that is bend in recess shape. Furthermore, various shapes such as parabola and part of a circle are applicable for the contour shape of the cross section by the surface containing the rotation axis of the turbine in the inner peripheral surface 1*a*.

Furthermore, the second embodiment may also be applied to the split ring 1 having the above-described waffle grid rib 10 which is the first embodiment.

As described above, according to the gas turbine split ring of one aspect of the present invention, in the waffle grid rib formed on the outer peripheral surface, the axial rib is formed to be higher than the circumferential rib so as to increase the section modulus in the axial direction and predominately decrease the amount of heat deformation in the axial direction which largely contributes the change of the tip clearance compared to the amount of heat deformation in the circumferential direction, with the result that it is possible to efficiently suppress the change of the tip clearance due to a temperature difference.

Moreover, the amount of heat deformation in the axial direction is reduced compared to the conventional case by forming the axial rib to be higher than the circumferential rib, while the shape of the split ring before heat deformation is formed in expectation of heat deformation which will nonetheless occur, with the result that it is possible to control the tip clearance after heat deformation more properly.

According to the gas turbine split ring of another aspect of the present invention, the shape of the split ring before heat deformation is formed in expectation of heat deformation regardless of presence/absence of the waffle grid rib, with the result that it is possible to control the tip clearance after heat deformation more properly.

Moreover, it is possible to control the tip clearance after heat deformation properly even for the substantially center part in the axial direction of the inner peripheral surface of the split ring where heat deformation is the maximum.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A gas turbine split ring which is provided on a peripheral surface in a cabin at a predetermined distance with respect to a tip end of a moving blade, the split ring comprising a plurality of split structure segments connected in a circumferential direction to form a circular ring shape, each split structure segment having cabin attachment flanges extending in the circumferential direction on both of an upstream side and a downstream side of the split ring, wherein on an outer peripheral surface between the two cabin attachment flanges of the split structure segment, a circumferential rib which extends in the circumferential direction and an axial rib which extends in a direction parallel to an axis of the circular ring shape and has a height taller than the circumferential rib are formed in plural lines.

2. The gas turbine split ring according to claim 1, wherein the split ring is formed to have a shape before heat deformation such that an inner peripheral surface of the split structure segment and the tip end of the moving blade have a predetermined interval in a heat deformed condition in an operating state of a gas turbine.

3. The gas turbine split ring according to claim 2, wherein the shape before heat deformation is such a shape that the interval between the inner peripheral surface and the moving blade decreases with the distance from a substantially center part of the inner peripheral surface to both of the upstream and downstream sides.

* * * * *